US005662226A

United States Patent [19]

Till

[11] Patent Number: 5,662,226

[45] Date of Patent: Sep. 2, 1997

[54] KEGGING FACILITY CONTROL PROCESS AND APPARATUS

[75] Inventor: Volker Till, Hofheim am Taunus, Germany

[73] Assignee: GEA Till GmbH & Co., Kriftel, Germany

[21] Appl. No.: 405,301

[22] Filed: Mar. 16, 1995

[30] Foreign Application Priority Data

Mar. 16, 1994 [DE] Germany ..... 44 08 842.6

[51] Int. Cl.[6] ..... B07C 5/00

[52] U.S. Cl. ..... 209/2; 209/523; 209/552; 141/94

[58] Field of Search ..... 209/2, 522, 523, 209/552; 141/92, 168, 83, 69, 70, 94, 98, 129, 157

[56] References Cited

U.S. PATENT DOCUMENTS 3,648,742 3/1972 Beech .

5,067,616 11/1991 Plester et al. ..... 209/523 X

FOREIGN PATENT DOCUMENTS 2 052 801 6/1980 United Kingdom .

2 182 434 5/1987 United Kingdom .

*Primary Examiner*—David H. Bollinger

*Attorney, Agent, or Firm*—Chilton, Alix & Van Kirk

[57] ABSTRACT

The automation of a keg filling process is enhanced by classifying the abnormalities detected during a multi-stage treatment and filling process, the abnormalities being classified as either container-related or treatment step-related. Kegs for which an abnormality has been detected are ejected from the production line and are automatically routed either to a repair station or reintroduced into the production line as a function of the classification of the abnormality.

15 Claims, 1 Drawing Sheet

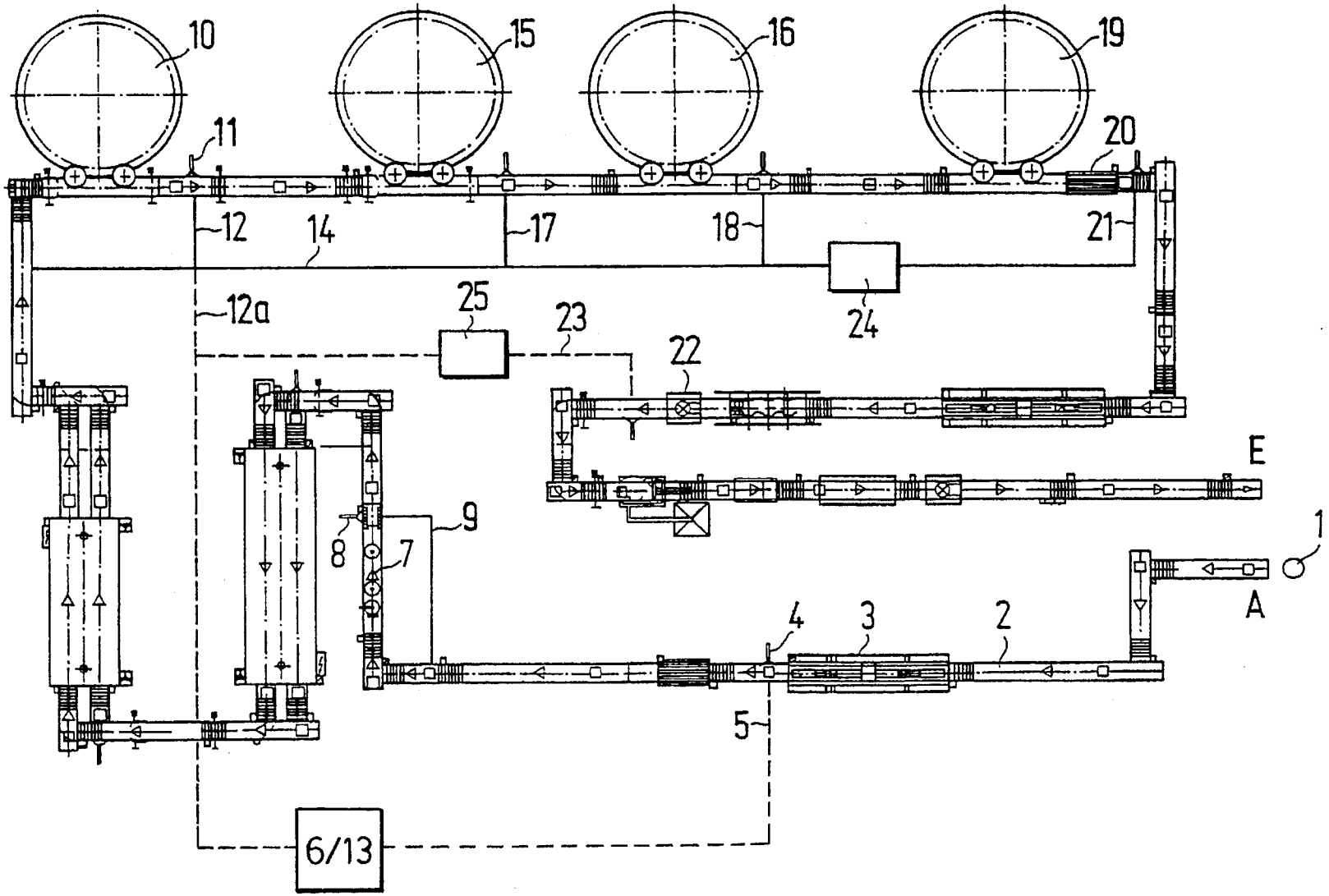
1
A
E
2
3
4
5
6/13
7
8
9
10
11
12
12a
14
15
16
17
18
19
20
21
22
23
24
25

KEGGING FACILITY CONTROL PROCESS AND APPARATUS

BACKGROUND OF THE INVENTION

1. Field of the Invention

The present invention relates to the exercise of supervisory control over the movement of containers in a kegging facility and, particularly, to the routing of kegs in a multi-station plant as a function of tests and/or inspections performed at or immediately downstream of various of the stations. More specifically, this invention is directed to an intelligent controlled conveyor system for a multi-station kegging facility and, especially, a conveyor system which transports, recirculates and ejects kegs in accordance with conditions observed or monitored at various locations along a production line on which the kegs are readied for processing, cleaned and filled. Accordingly, the general objects of the present invention are to provide novel and improved methods and apparatus of such character.

2. Description of the Prior Art

While not limited thereto in its utility, the present invention is particularly well suited for use in connection with the "kegging" of beverages, especially beer, in reusable barrel like kegs. It is common practice in the beverage industry to employ fully automated production facilities wherein empty kegs are cleaned, usually in a multi-step process, and then filled. In such automated production facilities, the kegs are serially treated at several stations, i.e., are manipulated by a number of machines arranged one after the other, located along a transport path, i.e., the production line. The individual cleaning and filling stations are interlinked by conveyor paths, which may be defined by belts, on which the kegs are conveyed.

As is normal practice in the food industry, the containers in which beverages are distributed must meet strict requirements for cleanliness and both the quality and quantity of the product placed in the container must be strictly controlled. Accordingly, the machinery treating the keg at various points along a kegging line, conduct tests and/or examinations to ensure that the treatment being performed on the keg, as well as the keg itself, complies with the industry requirements. If such tests or examinations identify a defect in the keg or a malfunction of the apparatus or processing step performed at a treatment station, the keg must be separated out of the kegging facility's production flow. Such separation will be performed after discharge of the keg from the machines on the transport path which defines the production line by means of ejectors. The ejectors move a keg for which an abnormality has been identified from the production line onto an ejector conveyor without disturbing the automated production line. In the prior art, the ejector conveyors were dead-ended, i.e., the ejected kegs were simply moved to the side to await attention by an operator. The operator, when time permited, conducted tests to determine whether the keg was defective, and thus required repair, or whether the keg was ejected from the production line as a result of machine error or a malfunction at a treatment station. If the operator determined by visual inspection of the keg that the ejection was not as a result of a defective keg, the keg would be manually reinserted in the production line after being emptied if necessary. The inspection and rerouting of ejected kegs is a highly labor intensive process and, as bottling facility capacity increases, the number of personnel required for inspection and movement of ejected kegs increases.

SUMMARY OF THE INVENTION

The present invention overcomes the above-briefly discussed and other deficiencies and disadvantages of the prior art by providing a novel process, and apparatus for use in the practice of that process, wherein manipulation of containers ejected from a kegging production line is automated in such a manner as to significantly reduce labor costs. In accordance with the invention, the reason for container ejection is identified and classified and the ejected container is subsequently caused to follow a path determined by the classification of the reason for ejection. The path followed may result in the container being reinserted in the production line at an appropriate point without manual intervention.

in accordance with a preferred embodiment, in the practice of the present invention, tests and/or examinations are performed at each treatment station. The conditions which are sensed and/or the parameters which are measured will be a function of the treatment performed at the station. When an abnormality is detected, that abnormality is classified as to whether it is potentially a keg-related defect, treatment station equipment related or environment related, for example, as missing supply of cleaning detergent or steam or water or other utility energy. The keg is then "tagged" in the production line controller (PLC) which is controlling the process and, when an equipment related and/or environment related abnormality is identified, the keg is separated out of the production line and subsequently fed back into the production line at a point upstream of the treatment station where the abnormality was detected, the reinsertion point being commensurate with the nature of the abnormality. If a keg-related defect type of abnormality is identified during the testing/inspection conducted at a treatment station, the keg will be automatically ejected and routed to a repair station.

To summarize the above discussion; since the abnormalities which are looked for at the individual stations of the bottling facility production line are specific to that station, information as to whether the abnormality is related to the keg, the treatment station apparatus and/or the environment can be assigned to an ejected container by the PLC and such assigned information employed to determine the further treatment of the container. In the practice of the invention, because of the automatic feedback of kegs which have been separated out as a consequence of equipment-related or environment-related abnormalities, the number of kegs which have to be inspected by an operator is reduced by usually more than eighty percent.

Also in accordance with a preferred embodiment of the invention, wherein the kegging facility is employed in the filling of beer kegs and includes a pre-wash station followed by additional cleaning station(s) upstream of the keg filling station, the kegs which are ejected from the production line downstream of the pre-wash station because of identified equipment-related and/or environment-related abnormalities are returned to the production line immediately upstream of the prewash, i.e., the first internal washing, station. The keg cannot be reintegrated into the production flow of the kegging facility at the point where it was ejected because the ejection was a consequence of the fact that a cleaning step or the filling process was not properly carried out. Therefore, the entire cleaning and filling process will be done over. A particular advantage of this technique resides in the fact that, since, an inspection of the fill properties of the keg is usually made during the pre-wash, a keg reintroduced upstream of the pre-wash will be automatically rechecked at the pre-wash station to ensure that the barrel itself is not defective. If the kegging line does not have a pre-wash station, the ejected normal kegs will be reintroduced upstream of the station where the first internal cleaning is performed.

Experience has shown that those problems which are identified in a keg cleaning/filling process downstream of the pre-wash/first internal cleaning station are to a high percentage attributable to the cleaning and filling apparatus or environmental factors such as low cleaning fluid pressure. Thus, in accordance with one embodiment of the invention, kegs which are ejected from the production line downstream of the pre-wash, i.e., after the first internal cleaning, will be automatically reintroduced into the production line upstream of the first internal cleaning station. Restated, in the practice of the present Invention, problems related to defective kegs are separated from problems related to the production line equipment or the environment, and kegs which are not defective can automatically be fed back to the cleaning/filling procedure inlet stage.

Obviously, kegs which are defective cannot be reused without repair. Accordingly, pursuant to the practice of the preferred embodiment of the invention, kegs which are ejected from the production line because of defects are automatically routed to a repair station. Thus, the kegging facility operator does not need to devote highly salaried personnel to the inspection of ejected kegs and transportation thereof to a repair station.

If a keg is ejected downstream of the filling station, it will contain product liquid. Ejection downstream of the filling station will typically result from testing which reveals that the keg has been underfilled. Ejection after filling may also occur if inspection reveals leakage in the keg fitting. In accordance with a preferred embodiment of the invention, kegs which are ejected from the production line during or after filling will be automatically directed to a decanting station where the keg will be emptied. Thereafter, the keg will either be returned to the production line or routed to the repair station. The product liquid extracted from a keg at a decanting station will be used to fill other kegs.

A production line of a kegging facility in accordance with the invention will comprise a conveyor for transporting containers, particularly kegs, to the serially arranged treatment stations for cleaning and filling. Control devices for inspecting the functions and properties of the kegs and the cleaning/filling processes, as well as ejectors disposed along the keg transport path defined by the conveyor, form part of the production line, The ejectors will selectively remove improperly treated or defective kegs to branch conveyors which, depending on the reason for ejection, will transport an ejected keg to a point in the production line located upstream of the first cleaning station or to a repair station.

In one implementation of the invention, the conveyors which transport kegs ejected after the first internal cleaning step communicate with a main collector conveyor which returns all of the kegs ejected for reasons other than a keg defect to a common point on the production line. This common point is located upstream of the first station where an internal treatment is performed on the kegs. Thus, kegs separated at the various stations along the bottling production line are bundled on a common collector conveyor for reintroduction to the production line.

The point of merging of the common collector conveyor for ejected kegs and the main production line conveyor will preferably be upstream of the station where the first internal cleaning of the incoming kegs is performed. Accordingly, kegs which are separated from the production line because of equipment-related or environment-related abnormalities will be reinspected for barrel-related defects at the first treatment station.

In order to ensure that kegs which are ejected from the production line because of keg-related defects are not reintroduced to the production line, the invention provides that the conveyors on which these kegs are transported after ejection lead directly to a repair station.

In a kegging facility, it is usually necessary to perform certain preparatory treatment steps on the kegs which are to be cleaned and filled. Examples of such preparatory treatment steps are the removal of a protective cap from the keg fitting and pre-washing. Such preparatory treatment steps are performed automatically and, if a problem occurs during such steps, compensation can be achieved simply by repeating the step. A preferred embodiment of the invention provides that, when a treatment or equipment related abnormality occurs at a preparatory treatment station, the subsequently ejected keg will automatically be returned to the inlet of that station. This permits the problem to be eliminated without the keg making a costly circuit through the kegging facility.

As noted above, in order to avoid waste of product liquid contained in a keg which has been separated out of the production line downstream of the filling station, apparatus in accordance with the present invention is provided with at least a first decanting station at which ejected kegs are emptied.

BRIEF DESCRIPTION OF THE DRAWINGS

The present invention may be better understood, and its numerous objects and advantages will become apparent to those skilled in the art, by reference to the accompanying drawing which is a schematic representation of a kegging facility production line in accordance with a preferred embodiment of the invention.

DESCRIPTION OF THE DISCLOSED EMBODIMENT

A production line of a kegging facility is shown schematically in the drawing. This production line has an intake station A-at which the incoming kegs 1 are placed on a conveyor which has been indicated at 2. The conveyor 2 may comprise a series of intersecting conveyor belts which cooperate to define a transport path between the intake station A and a removal station E where filled kegs are collected and subsequently transported to customers.

A keg 1 will serially pass through a number of work stations as it progresses along the transport path defined by conveyor 2. In passing these work stations, the keg will be prepared for use, cleaned and ultimately filled as it moves along the production line. Since the keg 1 is usually delivered to intake station A on a pallet with the fitting facing upwardly and protected by a cap, the first manipulative step performed is the inversion of the keg so that the fitting will face downwardly. This manipulation is required since the cleaning and filling of keg 1 is customarily performed with the fitting, which is integrated into the keg base via a collar and includes an automatic shut-off valve, inserted in and sealed to a cleaning or filling head. In the production line depicted in the drawing, a turning machine is indicated at 3. The keg is inspected, via image-processing for example, at station 3 for deformations in the barrel collar which receives the fitting and/or for potential misalignment of the fitting with the collar. If a keg-related defect is found at station 3, an ejector 4, operating substantially transversely to the transport path of conveyor 2, will push the defective keg off conveyor 2 and onto an ejector conveyor 5. The ejector conveyor 5 transports the defective keg directly to a repair station 6. In the interest of facilitating understanding of the invention, the conveyors which lead to a repair station have been indicated by broken lines.

If the inspection at the turning station 3 fails to reveal an abnormality, the keg will be transported to the next preparatory treatment station 7 which, in the disclosed embodiment, is a cap-removal station. The protective cap is removed from the keg fitting at station 7. Kegs leaving cap-removal station 7 are checked to ensure that the protective cap was removed and, if not, the keg will be ejected from conveyor 2 by means of an ejector 8. A keg removed from the production line by ejector 8 will be returned to the production line at a point immediately upstream of the cap removal station 7 by a single station loop conveyor 9. Thus, if the cap removal procedure is unsuccessful, the keg will be reintroduced into the production line upstream of the cap removal station and a second attempt will be made to remove the cap. The possibility that a protective cap cannot be successfully removed from an incoming keg is exceeding small. In the drawing, the conveyors whereby a keg 1 is returned to the production line/transport path defined by conveyor 2 are indicated by a solid line.

After leaving cap removal station 7 on conveyor 2, the keg will be transported to the first of a series of internal treatment stations. As it passes through these treatment stations the keg is cleaned and sterilized so as to be ready to receive the beverage product. The first of these internal treatment stations will be the pre-wash station which has been indicated at 10. Intermediate the cap removal station and prewash station the production line includes means for accumulating a supply of incoming kegs. At pre-wash station 10 the fill properties of the keg are checked. Thus, at station 10, the keg seal, the stroke behavior of the fitting valve and the flow behavior of the keg are tested. If this testing reveals a defect, that defect will be a keg-related abnormality and the defective keg is ejected from conveyor 2 immediately downstream from pre-wash station 10 by means of an ejector 11. Ejector 11 will place the ejected keg on an ejector conveyor 12 which leads to a further ejector conveyor **12*a*. Conveyor 12*a* transports the defective keg to a repair station 13. In the disclosed embodiment, a common repair station 6/13** is employed.

It is possible that equipment-related or environment-related problems can occur at the pre-wash station 10. For example, there may be insufficient steam, water or pressure to ensure proper pre-washing of the keg. Pre-wash station 10 also includes means for monitoring the pre-wash procedure. If a treatment abnormality is detected; the keg cannot be permitted to continue toward the filling station, and is thus ejected by ejector 11, but is not defective and thus should not be placed on conveyor **12*a* for transport to repair station 13. Accordingly, means are provided to redirect ejected but not defective kegs from ejector conveyor 12 to a common collection or feedback conveyor 14. Feedback conveyor 14 then transports the keg back to the production line, i.e., the main conveyor 2, upstream of pre-wash station 10. The keg 1 will thereby be caused to again undergo the inspection performed at pre-wash station 10**, as described above, and the pre-washing will be repeated.

Continuing with the above discussion of the nature of the problems which may be detected at pre-wash station 10, the type of problem must be classified as either a keg-related or non-keg-related abnormality and the classification "assigned" to the keg in order to determine whether an ejected keg should be routed onto feedback conveyor 14 or allowed to continue on to conveyor **12*a* which leads to repair station 13. A production line controller, in response to the classification assigned to an ejected keg, will act at the point where ejector conveyor 12 intersects feedback conveyor 14** to cause the ejected keg to be further transported on the appropriate of the intersecting conveyors.

Downstream of pre-wash station 10, the production line/conveyor 2 serially passes through cleaning stations 15 and 16. It is highly probable that any malfunctions that occur at cleaning stations 15 and 16 result from the operation of the equipment at the stations or from environmental factors. Accordingly, if the testing performed at cleaning stations 15 and 16 reveals an abnormality, the keg 1 will be ejected and placed on the appropriate one of the ejector conveyors 17 and 18. Kegs moved onto ejector conveyors 17 and 18 will be rerouted onto feedback conveyor 14 and returned to the production line/conveyor 2 upstream of pre-wash station 10.

After the cleaning cycle, performed at stations 10, 15 and 16, the keg 1 will be filled with product liquid, beer for example, at filling station 19. The filled kegs leaving station 19 are weighed on a scale 20. The PLC connected to the filling apparatus at station 19 monitors whether the keg has been successfully filled and, employing information collected by sensors associated with the equipment at stations 10, 15 and 16, classifies the keg 1 in accordance with its treatment. If scale 20 indicates that a keg has been underfilled, or if any other problem occurs at filling station 19, the keg will be ejected from conveyor 2 and delivered, via ejector conveyor 21, to feedback conveyor 14. However, the feedback conveyor 14 is interrupted upstream of the junction with ejection conveyor 18 by a decanting station 24 so that any product liquid placed in the keg at filling station 19 may be withdrawn and used to fill another keg. The emptied keg exiting decanting station 24 will be delivered back to conveyor 2, upstream of pre-wash station 10, via feedback conveyor 14.

A properly filled keg is subjected to a final test at a leak-detection station 22. If the inspection at station 22 reveals any leakage, this leakage will definitely be a keg-defect abnormality. The keg will, accordingly, be ejected and delivered, via an ejector conveyor 23, to a decanting station 25. After the product liquid has been removed from the ejected keg at decanting station 25, the keg is delivered to the ejector conveyor **12*a* and thence to repair station 13**.

To summarize, by automatically ejecting defective kegs, and especially, by differentiating between keg-related defects and abnormalities which are either equipment-related and/or environment-related, the present invention minimizes the number of operating personnel needed to attend a keg fill production line. Thus, the invention constitutes a novel and efficient production tool which separates defective containers from those which may be reintroduced to the keg filling line.

As is well known, a keg has a built-in valve, i.e., the so-called spear which is sometimes referred to as the fitting. The fitting consists of two concentric valves, the Center valve and the ring valve. During cleaning, the center valve is used to supply washing liquid and the ring valve to return such liquid. The ring valve is normally employed to fill the keg and the center valve employed to let gas out of the keg during such filling.

The process control checks for example, the following:

1. The integrity of the fitting by checking to see if the "spear" is still in line with the keg or bent. A misaligned fitting will prevent establishment of a seal between keg and the gasket of the relevant washing and/or filling head.
2. The function of the fitting by checking to determine if the opening of the relevant valve(s) is possible.
3. The seal of the fitting and the integrity of the keg by checking if there is a residual pressure in the returning keg.

4. The flow rate permitted by the center valve.
5. The time until the washing liquid returns at the discharge (ring) valve to thereby check the aperture of such valve.
6. The total exterior height and diameter of the keg in order to detect damage in the form of distortion.
7. The volume of the keg.

The above-mentioned checks permit determination of the existence of keg damage and/or malfunction and may be performed at one or several stations alone or in combination. There are, however, a plurality of additional checks for keg damage or malfunction.

The non-keg related abnormalities which will cause an ejection are as follows and measured as follows:

A) Machine related abnormalities, (examples not limited to all possible abnormalities):

8. The seal between the keg and the treatment head gasket which may be compromised by a damaged gasket. Such check is done by pressure measurement and good seals differentiated from bad using statistics. Thus, a failure showing up with every keg is most likely to be a process head failure and thus a machine related abnormality. An abnormality showing up only from time to time is most probably a keg related problem.
9. The movement of the piston of the treatment station equipment to open the keg for treatment. A non-moving piston would not open a keg, thus for treatment or filing and is a machine-related abnormality.
10. A non-moving keg clamping cylinder is a machine-related abnormality.
11. The actuator for the piston and clamping cylinder are checked by monitoring time and feedback signals.
12. All utility supply valves have monitors with feedbacks. A non-opening washing liquid valve would prohibit cleaning, since no liquid can get to the keg. Such valve opening is monitored and a feedback signal commensurate with a non-opening valve indicates a machine failure.
13. The same applies for a non-closing valve, allowing different liquids to mix. This is a machine failure, process unclear.
14. Valve state feedback signals can only indicate an open or closed valve, The presence of both signals would indicate one or both of the valve and associated sensor to be defective and thus a machine-related fault, process unclear.
15. The liquid from a keg is monitored by ultrasonic or other type of probes to determine if it is wet or dry. A keg not signalling wet is not treated. This indicates a machine fault, if it shows up every time.
16. There are many more such machine related reasons. The logic currently employed checks for about 200 other potential abnormalities.

The present invention also has the capability to automatically prevent defective treatment stations from being loaded with kegs to thereby prevent unnecessary treatment of kegs which will subsequently be rejected.

B) Utility (environmental) related abnormalities.

17. All liquids, steam and compressed air supplied are checked for correct pressure. If the pressure during the process is reduced for any external reason, the process will not be completed correctly as predetermined. This is a utility failure leading to ejection of the keg for safety reasons.
18. If temperature, for example that of a washing detergent, drops during treatment, proper cleaning cannot be guaranteed and consequently the keg is rejected.
19. If the concentration of the detergent is not sufficient during a draining process, such keg will be rejected.
20. If the compressed air is not dry, but contains water or condensate, a keg treated during a process step which requires such air is rejected.
21. There are many other environment-related reasons which depend on the degree of process control dictated by the customer.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a process for the filling of kegs, the process including the delivery of kegs which are to be filled with a product liquid along a transport path to a plurality of successively arranged treatment stations whereby each keg is prepared for use, cleaned and filled, tests being performed at each treatment station to identify abnormalities in the keg and/or treatment step, the improvement comprising:

classifying each identified abnormality either as a keg defect or as treatment step related;

ejecting kegs for which an abnormality has been identified from the transport path; and automatically reintroducing kegs for which the identified abnormality has been classified as treatment step related back into the transport path at a point upstream of where the test which identified the abnormality was conducted.

2. The process of claim 1 further comprising:

automatically transporting all kegs for which a keg defect abnormality was identified to a repair station.

3. The process of claim 2 wherein at least one of the treatments may be successively conducted to overcome any abnormality in the performance thereof and wherein said process further comprises:

routing kegs ejected downstream of the station where said at least one treatment is conducted as a result of an identified treatment step abnormality back to the inlet side of said station to thereby attempt to correct the identified abnormality by retreatment.

4. The process of claim 1 wherein at least one of the treatments may be successively conducted to overcome any abnormality in the performance thereof and wherein said process further comprises:

routing kegs ejected downstream of the station where said at least one treatment is conducted as a result of an identified treatment step abnormality back to the inlet side of said station to thereby attempt to correct the identified abnormality by retreatment.

5. The process of claim 4 further comprising:

transporting all kegs ejected from the transport path downstream of a filling station to a decanting station; and delivering kegs for which a keg defect abnormality was identified to a repair station after removing the product liquid therefrom at the decanting station.

6. In a process for the filling of kegs, the process including the delivery of kegs which are to be filled with a product liquid along a transport path to a plurality of successively arranged treatment stations whereby each keg is prepared for use, cleaned and filled, one of the treatment steps comprising a pre-wash, tests being performed at each treatment station to identify abnormalities in the keg and/or treatment step, the improvement comprising:

classifying each identified abnormality either as a keg defect or as treatment step related;

ejecting kegs for which an abnormality has been identified from the transport path; and automatically reintroducing kegs for which the identified abnormality has been classified as treatment step related back into the transport path at a point upstream of where the test which identified the abnormality was conducted, kegs for which a pre-wash treatment step abnormality or a treatment step abnormality occurring downstream of the pre-wash step is detected being reintroduced to the transport path at a common point upstream of the pre-wash.

7. The process of claim 6 further comprising:

automatically transporting all kegs for which a keg defect abnormality was identified to a repair station.

8. The process of claim 7 wherein at least one of the treatments may be successively conducted to overcome any abnormality in the performance thereof and wherein said process further comprises:

routing kegs ejected downstream of the station where said at least one treatment is conducted as a result of an identified treatment step abnormality back to the inlet side of said station to thereby attempt to correct the identified abnormality by retreatment.

9. The process of claim 8 further comprising:

transporting all kegs ejected from the transport path downstream of a filling station to a decanting station; and delivering kegs for which a keg defect abnormality was identified to a repair station after removing the product liquid therefrom at the decanting station.

10. The process of claim 6 wherein at least one of the treatments may be successively conducted to overcome any abnormality in the performance thereof and wherein said process further comprises:

routing kegs ejected downstream of the station where said at least one treatment is conducted as a result of an identified treatment step abnormality back to the inlet side of said station to thereby attempt to correct the identified abnormality by retreatment.

11. In a process for the filling of kegs, the process including the delivery of kegs which are to be filled with a product liquid along a transport path to a plurality of successively arranged treatment stations whereby each keg is prepared for use, cleaned and filled, tests being performed at each treatment station to identify abnormalities in the keg and/or treatment step, the improvement comprising:

classifying each identified abnormality either as a keg defect or as treatment step related;

ejecting kegs for which an abnormality has been identified from the transport path;

transporting all kegs ejected from the transport path downstream of the filling station to a decanting station;

automatically reintroducing kegs for which the identified abnormality has been classified as treatment step related back into the transport path at a point upstream of where the test which identified the abnormality was conducted, kegs for which a treatment step abnormality is first detected after filling being emptied at the decanting station before reintroduction; and delivering kegs for which a keg defect abnormality was identified downstream of the filling station to a repair station after removal of the product liquid therefrom at the decanting station.

12. The process of claim 11 further comprising:

delivering product liquid removed from a keg at the decanting station to the filling station for use.

13. In apparatus for the processing of reusable containers, the container including an integral valve and being intended for filling with a product liquid, said apparatus including a conveyor which defines a transport path and a plurality of container treatment stations positioned serially along the transport path, the apparatus further comprising sensors associated with each treatment station for detecting abnormalities in the container and/or treatment performed at the station, the improvement comprising:

means for determining whether an abnormality detected at a treatment station is a container defect type or a treatment defect type;

means for assigning the type of defect to a container for which an abnormality has been identified;

ejector means located downstream of each treatment station for ejecting containers for which an abnormality has been detected;

an ejector conveyor associated with each said ejector means;

means for intercepting containers on said ejector conveyors and rerouting containers for which the identified abnormality is a treatment related defect to a reintroduction point on the conveyor defined transport path; and means for delivering to a repair station ejected containers which are not rerouted by said intercepting means.

14. The apparatus of claim 13 wherein said intercepting means includes:

a common collector conveyor which returns the ejected containers to the reintroduction point.

15. The apparatus of claim 14 wherein the processing apparatus includes a first internal treatment station wherein the containers are subjected to a pre-wash and wherein said reintroduction point is located upstream of the first internal treatment station.

* * * * *